US005435028A

United States Patent [19]

Frala

[11] Patent Number: 5,435,028

[45] Date of Patent: Jul. 25, 1995

[54] PORTABLE SUPPORT APPARATUS

[76] Inventor: John L. Frala, 1007 Verret La., Houston, Tex. 77090

[21] Appl. No.: 198,560

[22] Filed: Feb. 18, 1994

[51] Int. Cl.[6] ..... A47C 31/00

[52] U.S. Cl. ..... 5/662; 5/503.1; 5/425; 297/DIG. 10; 135/66; 182/113

[58] Field of Search ..... 5/662, 503.1, 425, 426, 5/658; 297/411.23, DIG. 10; 135/65, 66, 67; 248/188.91, 910, 357; 182/113

[56] References Cited

U.S. PATENT DOCUMENTS

| | | | |
|---|---|---|---|
| 2,981,959 | 5/1961 | Burnham | 5/503.1 |
| 3,085,258 | 4/1963 | Wolferts | 5/503.1 |
| 3,176,322 | 4/1965 | Mulcahy | 5/503.1 |
| 3,474,473 | 10/1969 | Hannaberg | 5/426 |
| 3,553,746 | 12/1971 | Seiger | 5/503.1 |
| 4,922,560 | 5/1990 | Skibinski | 297/DIG. 10 |
| 5,082,086 | 1/1992 | Kerr | 182/113 |
| 5,121,516 | 1/1992 | Jones | 5/662 |
| 5,195,200 | 1/1993 | Leoutsakos | 5/662 |
| 5,295,498 | 3/1994 | Van Meter | 297/DIG. 10 |
| 5,305,773 | 4/1994 | Browning | 135/65 |

*Primary Examiner*—Flemming Saether

[57] ABSTRACT

A support apparatus including a main frame member extending in a generally vertical plane, a support frame member detachably connected to a bottom of the main frame member, and a foot connected to the main frame member so as to support the main frame member in a generally vertical plane. The main frame member has a top rail extending from a back rail toward the front rail at an acute angle. The support frame member extends horizontally rearwardly of the back rail. A mid-rail extends horizontally from the back rail to the front rail and is positioned below the top rail and above the foot. The foot includes a first flat plate affixed to the support frame member adjacent the connection with the main frame member and a second flat plate affixed to the support frame member rearwardly of the first flat plate. These flat plates extend in a horizontal plane.

16 Claims, 3 Drawing Sheets

PORTABLE SUPPORT APPARATUS

TECHNICAL FIELD

The present invention relates to apparatus for the assistance and support of persons. More particularly, the present invention relates to rail-type support devices that allow a person to lift themselves from a seated and/or lying position.

BACKGROUND ART

The task of transferring into or out of a bed or a chair can be a difficult task for some elderly, handicapped, and physical therapy patients. Such tasks are particularly difficult for those chronic or terminal patients alone in the home environment. This task could be impossible for some individuals without a care giver or some device to assist them. Family members might not be physically capable of assisting the individual. The full time care givers can be economically prohibitive. The loss of strength, or pain in the lower body, hips, knees, ankles, legs, or feet can significantly affect an individual's ability to perform these simple but necessary tasks. All beds, including hospital beds or chairs, except for those power lift chairs which are very expensive, provide no surface or structure to grasp in order to assist the entry or exiting of the bed or chair. Therefore, it would be beneficial to provide a device that allows an individual to utilize their upper body strength so as to perform a pulling motion for lifting from the bed or chair. It is generally accepted that the muscle group used for pulling is typically stronger than the group used for pushing.

Various U.S. patents have issued in the past for support apparatus that can be used for the assistance of an individual. For example, U.S. Pat. No. 5,257,426, issued on Nov. 2, 1993, to T. Leoutsakos describes a manual support device which is attachable to a bed frame. This manual support apparatus has two primary parts: a planar plate member and at least one support tube. The planar plate member has outside edges for alignment with the side and end rails of a bed frame. The support tube is attached to a planar plate member. As such, this device is a somewhat permanent fixture attached to the existing bed. The upper portion of the frame has a curved and straight configuration. There is a bar angled over the bed for the purpose of assisting the person upwardly from the bed.

International Publication No. WO 82/02832, published on Sep. 2, 1982, shows a bracket for a bed which is intended to allow a person to raise or lower from a bed. This includes one arm which is rotatably connected to a frame. The frame is formed of a series of tubes engaged telescopically to each other. These tubes are supported upwardly from a base which is laid on the floor next to the bed and is attached to the bed frame with a clamp. The arm may be moved by the person in bed between a parallel position over the bed to a parallel position away from the bed.

U.S. Pat. Nos. 3,668,723, 3,739,793, 3,553,746, and 3,591,874 teach support devices that are used to help people to get up from a particular location. These support devices can be placed under a bed or chair for stability. For example, U.S. Pat. No. 3,668,723, issued on Jun. 13, 1972, to F. H. Bratton describes a frame which is partially affixed to a side of a bed. Riser rails are provided which allow the person to be seated at the end of the bed. The riser rails can be detachably connected to the frame. U.S. Pat. No. 3,739,793, issued on Jun. 19, 1973, to A. B. Wilson shows an aid for use in sitting down or standing up from the side of a bed. This frame has a pair of J-shaped legs extending from the bottom of the bed. The end of these legs are connected to a frame supported beneath the bottom of the bed. The entire apparatus is slidable to a position beneath the bed. U.S. Pat. No. 3,553,746, issued on Jan. 12, 1971, to H. W. Seiger shows another type of support device for helping a person out of bed. The support device includes a H-shaped base having an arm extending upwardly therefrom. The arm has a handle at an end opposite the base so as to provide for grasping leverage by the person in bed. U.S. Pat. No. 3,591,874, issued on Jul. 13, 1971, to N. A. O'Kennedy provides a structural aid for an invalid so that the invalid can be properly lifted from the seated position to a standing position. A base is provided that supports an arm above the base.

It is an object of the present invention to provide a support apparatus that effectively assists an individual to raise from or lower to a bed and/or chair.

It is a further object of the present invention to provide a support apparatus that is portable and easy to use.

It is another object of the present invention to provide a support apparatus that can be readily adapted for use in conjunction with a chair and/or a bed.

It is still another object of the present invention to provide a support apparatus that is easy to manufacture and relatively inexpensive.

These and other objects and advantages of the present invention will become apparent from a reading of the attached specification and appended claims.

SUMMARY OF THE INVENTION

The present invention is a support apparatus that comprises a main frame member extending in a generally vertical plane and having a top rail extending from a back rail toward a front rail at an acute angle, a support frame member is detachably connected to a bottom of the main frame member, and a foot means is connected to the main frame member so as to support the main frame member in a generally vertical plane. The support frame member extends horizontally rearwardly of the back rail of the main frame member.

The top rail extends upwardly from the back rail at a generally 35° angle. The top rail includes a horizontal portion adjacent the front rail. This horizontal portion extends from the angled portion of the top rail. A mid-rail extends horizontally from the back rail to the front rail. This mid-rail is positioned below the top rail and above the foot means. The back rail has a lesser height than the front rail. The top rail extends from a top of the back rail to a top of the front rail. A bottom rail extends from a bottom of the back rail to a bottom of the front rail. This bottom rail extends horizontally. The foot means is affixed to this bottom rail. The bottom rail has a greater length than a distance of the front rail to the back rail. The bottom rail has a portion extending rearwardly of the back rail. The support frame member is connected to this portion.

The foot means includes a flat plate affixed to a bottom of the bottom rail and extending transversely to a longitudinal axis of the bottom rail. The flat plate extends in a horizontal plane. The portion of the back rail has an open end opposite the front rail. This open end receives an end of the support frame member. At least two holes are formed in this portion of the bottom rail.

These holes are linearly aligned on opposite sides of this portion. The end of the support frame member has another pair of holes formed therein. These holes of the support frame member align with the holes of this portion so as to receive a pin member extending therein. This pin member is a bolt having a head on one side of the portion and a nut threadedly attached to the bolt on an opposite side of the portion of the bottom rail.

The support frame member is a longitudinal member engaging an end of the main frame member. The foot means is affixed to a bottom surface of the support frame member. The foot means extends transverse to a longitudinal axis of the support frame member. The foot means includes a first flat plate affixed to the support frame member adjacent the connection with the main frame member, and a second flat plate affixed to the support frame member rearwardly of the first flat plate. The first and second flat plates are in generally parallel relationship to each other. The first and second flat plates extend in a horizontal plane.

In one embodiment of the present invention, the first and second flat plates extend outwardly from one and only one side of the support frame member. In this embodiment, the first flat plate has a lesser length than the second flat plate.

In another embodiment of the present invention, the support frame member is connected to a mid-point of the first and second flat plates. The first and second flat plates extend outwardly on both sides of the support frame member. In this embodiment, the first flat plate has a lesser length than the second flat plate.

DETAILED DESCRIPTION OF THE INVENTION

Figure 1:
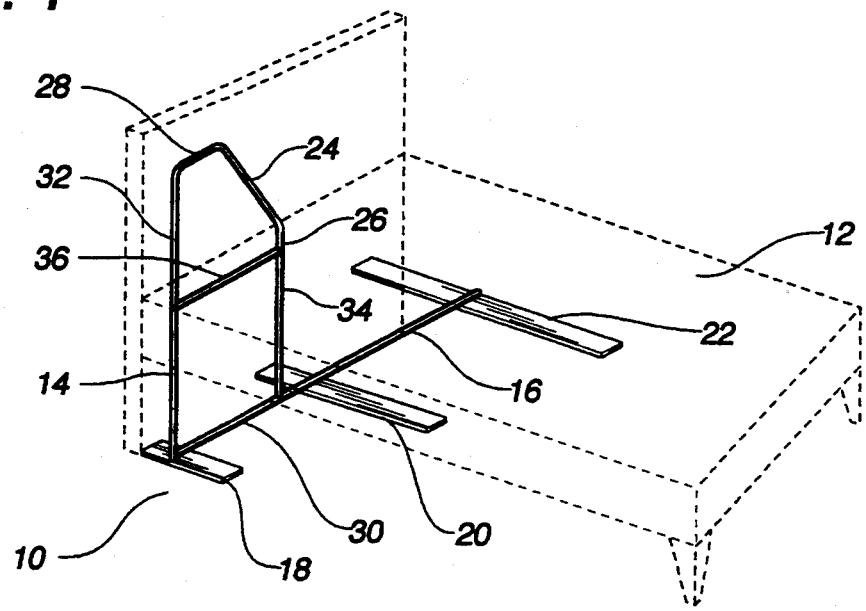
FIG. 1 is a perspective view of the present invention as employed in conjunction with a bed.

Referring to FIG. 1, there is shown at 10 the support apparatus in accordance with the preferred embodiment of the present invention. In FIG. 1, the support apparatus 10 is shown as used in conjunction with a bed 12. The support apparatus 10 includes a main frame member 14, a support frame member 16, and a plurality of feet 18, 20, and 22.

As illustrated in FIG. 1, the main frame member 14 is the visible and working part of the support apparatus 10. The main frame member 14 is oriented perpendicular to the bed 12 in a generally vertical plane. The main frame member 14 extends outwardly from the bed for approximately twenty inches and has an overall height of approximately forty-two inches. As can be seen, the top rail 24 has one end 26 (approximately 26 inches high) at bedside. This top rail 24 extends upwardly at an acute angle of approximately thirty-five degrees. This angled portion of the top rail 24 extends for approximately twenty inches. A horizontal section 28 (extending for approximately eight inches) is parallel to the floor and is the section that the individual "grabs" to assist themselves up or down. The main frame member 14 includes a bottom rail 30 extending between the front rail 32 and the back rail 34. The bottom rail 30 is approximately twenty-four inches in length. A portion of this bottom rail 30 extends underneath the bed 12. This portion of the bottom rail 30 has at least one pair of one-quarter inch holes drilled parallel to the floor centrally of the side walls of the tubing. In the preferred embodiment of the present invention, these holes will occur approximately one inch and three inches from the end of the tubing. A mid-rail 36 extends between the front rail 32 and the back rail 34 and below the top rail 24 and the bottom rail 30. The mid-rail 36 extends parallel to the horizontal section 28 and the bottom rail 30 at a height of approximately twenty-five inches. The mid-rail 36 serves to strengthen the main frame 14 and also to supply a second rail available for grabbing by the patient. The main frame member 14 is constructed of 1.5 inch O. D., 18 gauge carbon steel tubing. The front foot 18 is a flat plate that is positioned in a horizontal plane transverse to the main frame member 14. The foot 18 is four inches wide by twelve inches long. The flat plate is made of a carbon steel material. All of the consumer interface corners of the main frame member 14 are two and one-half inch radius bends. These "soft" bends serve to eliminate sharp corners. All of the components of the main frame member 14 are secured together by welding (or other forms of attachment). The main frame member 14 is coated with a dry spray, oven baked finish.

The support frame member 16 is the anchoring member of the assembly and is of a sufficient weight so as to secure the unit to the floor. Specifically, the support frame member 16 is constructed of 1.4 inch O. D. solid carbon steel rod. The support frame member 16 is a longitudinal member which is detachably connected to an end of the main frame member 14 below the bed 12. The support frame member 16 is approximately thirty-six inches in length. As will be described hereinafter, the support frame member 16 has holes which correspond to the holes in the end portion of the main frame member 14. The support frame member 16 has a first flat plate 20 affixed to the support frame member adjacent the connection with the main frame member 14. The support frame member 16 also includes a second flat plate which is affixed to the support frame member 16 rearwardly of the first flat plate 20. As can be seen, the first flat plate 20 and the second flat plate 22 are in generally parallel relationship to each other and extend in a horizontal plane. Each of the flat plates 20 and 22 serve to retain the support member 16 below the bed 12 while providing structural stability to the main frame member 14.

Figure 2:
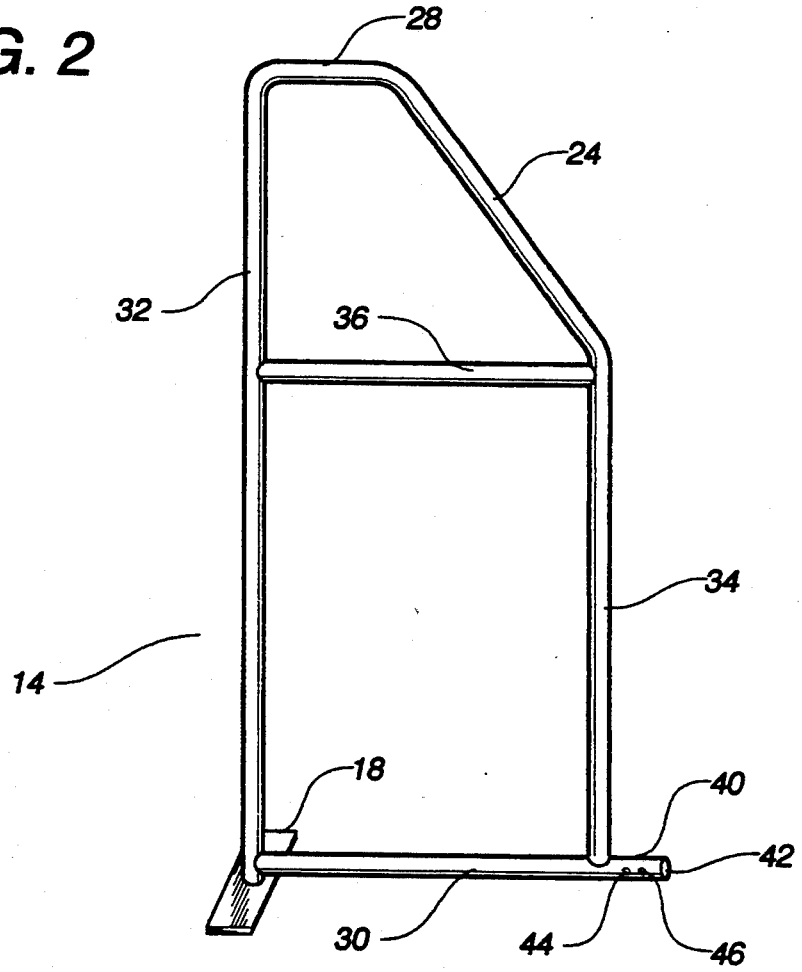
FIG. 2 is a side elevational view of the main frame member of the present invention.

FIG. 2 is an isolated view of the main frame member 14. As can be seen, the main frame member 14 has a top rail 24 that extends at an acute angle from the back rail 34 toward the front rail 32. The angled portion of the top rail 24 extends at a generally 35° angle. A short horizontal portion 28 extends from the top end of the angled portion of the top rail 24 toward the front rail 32. The mid-rail 36 extends between the back rail 34 and the front rail 32. A bottom rail 30 is affixed, at one end, to the front rail 32, is connected to a bottom of the back rail 34 and includes a portion 40 which extends rearwardly of the back rail 34. The portion 40 has an open end 42 so as to receive a corresponding end of the support frame member 16. A pair of holes 44 and 46 are formed through the walls of the bottom rail 30 so as to align with corresponding holes on the support frame member 16. The foot 18 is affixed below the bottom of the front rail 32 and is affixed to the bottom of the bottom rail 30. The foot 18 is a flat plate that supports the main frame member 14 in a generally vertical plane. As can be seen, all of the corners are rounded so as to provide additional safety.

After experimentation, it was found that the angled top rail 24 greatly facilitated the ability of the patient to pull themselves upwardly and outwardly from bed. In many occasions, the patient could "work" their way up along the angled portion of the top rail 24 until they had effectively pulled themselves from bed. The mid-rail 36 further facilitated the grasping ability of the patient and also assisted in allowing the patient to remove himself or herself from bed. The main frame member 14 can be used with the support frame member 16 (illustrated in FIGS. 1 and 3), or with the support frame member (illustrated in FIGS. 5 and 6).

Figure 3:
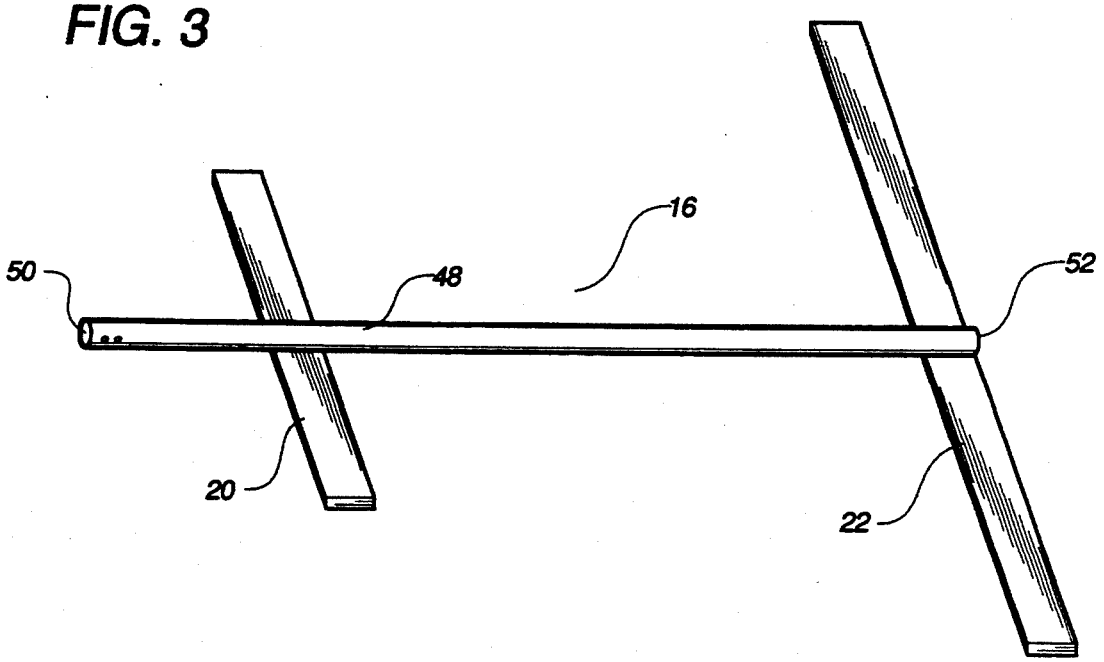
FIG. 3 is a perspective view of the support frame member as used in the preferred embodiment of the present invention.

In FIG. 3, the support frame member 16 is particularly illustrated. The support frame member 16 includes a longitudinal member 48 that has a first end 50 which is received within the open end 42 of the end portion 40 of the bottom rail 30 of the main frame member 14. The first flat plate 20 and the second flat plate 22 are affixed to the bottom surface of the longitudinal member 48 of the support frame member 16. The front first flat plate 20 extends transversely to the support frame member 16 and is positioned approximately six inches from the mating end 50 of the frame 16. The first flat plate 20 extends approximately one foot on both sides of the support frame member 16. The rear second flat plate 22 is affixed adjacent to the rear end 52 of the support frame member 16. This second flat plate 22 extends approximately eighteen inches on both sides of the support frame member 16. In other words, the longitudinal member 48 of the support frame member 16 is affixed generally at the mid-point of the first flat plate 20 and the mid-point of the second flat plate 22.

Figure 4:
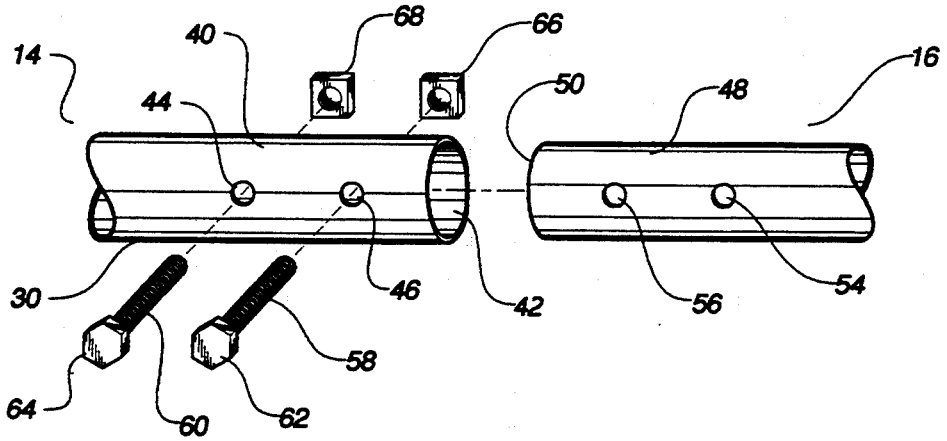
FIG. 4 is a detailed view of the connection between the main frame member and the support frame member.

FIG. 4 is an isolated view showing the connection between the end 50 of the longitudinal member 48 of the support frame member 16 and the end portion 40 of the bottom rail 30 of the main frame member 14. As can be seen, the end portion 40 includes a first hole 44 and a second hole 46. Corresponding holes 44 and 46 are found on the opposite side of the portion 40. The longitudinal member 48 includes a first hole 54 and a second hole 56. Corresponding holes are found on the opposite side of this longitudinal member 48 of the support frame member 16. As can be seen, the end 50 of the longitudinal member 48 is inserted into the open end 42 of the end portion 40 of the bottom member 30. The holes 54 and 56 of the longitudinal member 48 are brought into alignment with the holes 46 and 44, respectively, of the end portion 40. When this occurs, pin members 58 and 60 are inserted into these holes. The pin members 58 and 60 are two inch long by one-quarter inch diameter carriage bolts. The heads 62 and 64 of the bolts 58 and 60, respectively, will reside on one side of the end portion 40. Compression nuts 66 and 68 are threadedly affixed to the ends of the bolts 58 and 60 on the opposite side of the end portion 40. When the nuts 66 and 68 are secured to the bolts 58 and 60, respectively, the support frame member 16 will be rigidly secured to the main frame member 14.

Figure 5:
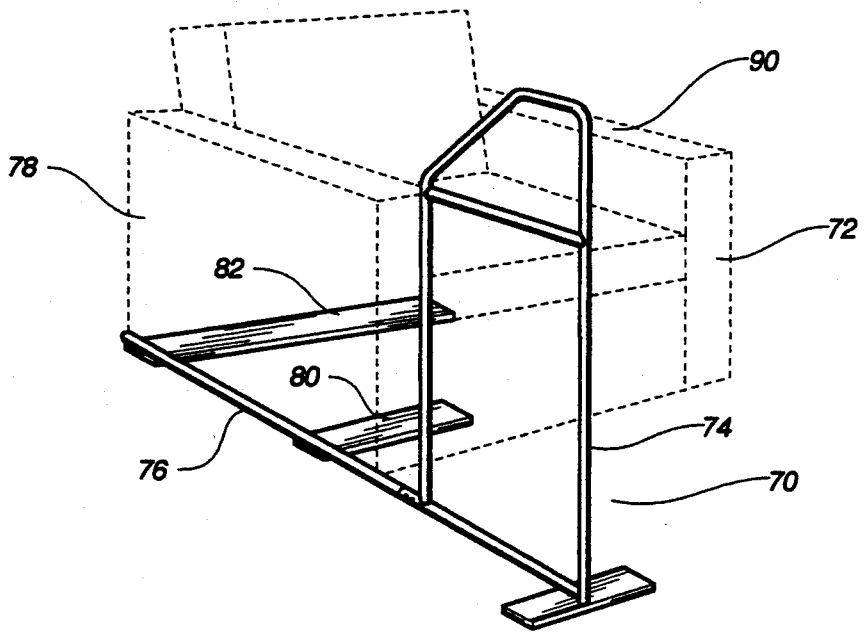
FIG. 5 is a perspective view showing an alternative embodiment of the present invention as used in conjunction with a chair.
Figure 6:
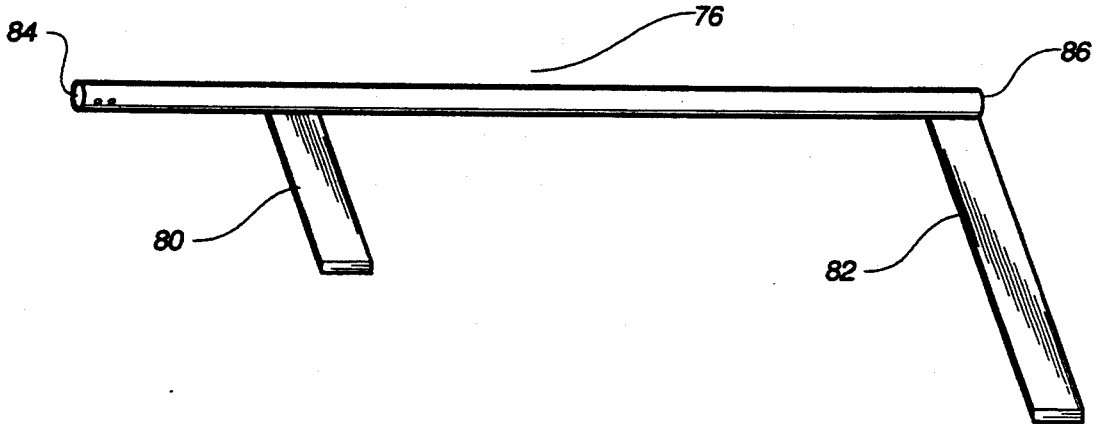
FIG. 6 is a perspective view showing the support frame member of this alternative embodiment of the present invention.

FIG. 5 shows an alternative embodiment of the present invention in which the support apparatus 70 is affixed beneath a chair 72. In this embodiment of the present invention, the main frame member 74 has a configuration similar to that of the main frame member 14 of the previous embodiment. The support frame member 76 extends rearwardly of the main frame member 74 and beneath the chair 72 adjacent to an arm 78 of the chair 72. The important difference between the embodiment 70 and the previous embodiment is the use of the first flat plate 80 and the second flat plate 82 which have a configuration particularly adapted for placement adjacent to the arm 78 of the chair 72. The flat plates 80 and 82 extend outwardly from one, and only one, side of the support frame member 76. The support frame member 76 is illustrated, with greater particularly, in FIG. 6. As can be seen in FIG. 6, the first flat plate 80 is affixed adjacent an end 84 of the support frame member 76. The second flat plate 82 is affixed adjacent to the end 86 of the support frame member 76. The first flat plate and the second flat plate 82 extend in a generally horizontal plane and in perpendicular relationship to each other. These plates 80 and 82 are affixed to a bottom surface of the support frame member 76. The plates 80 and 82 are illustrated as extending from only one side of the support frame member 76. As such, in this embodiment, the plates 80 and 82 are received beneath the arm 78 of the chair 72 without having additional portions extending outwardly of the chair. If the embodiment illustrated in FIG. 1 was used in conjunction with the chair 72, then portions of the flat plates 20 and 22 would extend outwardly of the arm 78 of the chair 72. This could cause an unnecessary obstruction.

It is important to remember that, in the present invention, the flat plates 80 and 82 can also be positioned on the opposite side of the support frame member 76 so as to facilitate the placement of the support apparatus 70 below the arm 90 of the chair 72. As such, the present invention can be adaptable so as to conform to the different arms of the chair.

It is important to note that, with the present invention, two bedside support frames and two main frames can constitute a double bedside unit. In this configuration, there is no predetermined distance between the main frames. This allows the user to adjust the distance between the frames for their most effective support. A double chair side unit can be achieved by utilizing a right chair side and a left chair side support frame, along with two main frames. The chair width will determine the proper distance between the two units. As such, the present invention is further adaptable to the needs of the user.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A support apparatus comprising:

a main frame member extending in a generally vertical plane, said main frame member having a top rail extending from a back rail toward a front rail at an acute angle;

a support frame member detachably connected to a bottom of said main frame member, said support frame member extending horizontally rearwardly of said back rail; and a foot means connected to said main frame member so as to support said main frame member in the generally vertical plane, said main frame member further comprising:

a bottom rail extending from a bottom of said back rail to a bottom of said front rail, said bottom rail extending horizontally, said foot means affixed to said bottom rail, said bottom rail having a length that is greater than a distance of said front rail to said back rail, said bottom rail having a portion extending rearwardly of said back rail, said support frame member connected to said portion.

2. The apparatus of claim 1, said top rail extending upwardly from said back rail at a generally 35° angle.

3. The apparatus of claim 2, said top rail having a horizontal portion adjacent said front rail, said acute angle of said top rail extending from an end of said horizontal portion opposite said front rail.

4. The apparatus of claim 1, said main frame member further comprising:

a mid-rail extending horizontally from said back rail to said front rail, said mid-rail positioned below said top rail and above said foot means.

5. The apparatus of claim 1, each of said front and back rails having a different height, said back rail having a lesser height than said front rail, said top rail extending from a top of said back rail to a top of said front rail.

6. The apparatus of claim 1, said portion of said bottom rail having an open end opposite said front rail, said open end receiving an end of said support frame member.

7. The apparatus of claim 6, said portion of said bottom rail having at least two holes formed therein, said holes being linearly aligned on opposite sides of said portion, said end of said support frame member having another pair of holes formed therein, said holes of said support frame member aligning with said holes of said portion so as to receive a pin member extending therethrough.

8. The apparatus of claim 7, said pin member being a bolt having a head on one side of said portion and a nut threadedly affixed to said bolt on an opposite side of said portion.

9. The apparatus of claim 1, said support frame member being a longitudinal member engaging an end of said main frame member, a second foot means affixed to a bottom surface of said support frame member, said second foot means extending transversely to a longitudinal axis of said support frame member.

10. The apparatus of claim 9, said foot means comprising:

a first flat plate affixed to said support frame member adjacent the connection with said main frame member; and a second flat plate affixed to said support frame member rearwardly of said first flat plate, said first and second flat plates in parallel relationship to each other, said first and second flat plates extending in a horizontal plane.

11. The apparatus of claim 10, said support frame having a side, said first flat plate and said second flat plate extending outwardly from said side and only said side of said support frame member, said first flat plate having a length which is less than a length of said second flat plate.

12. The apparatus of claim 10, said support frame member connected to a mid-point of said first and second flat plates, said first and second flat plates extending outwardly on both sides of said support frame member.

13. The apparatus of claim 12, said first flat plate having a lesser length than said second flat plate.

14. A support apparatus comprising:

a main frame member extending in a generally vertical plane, said main frame member having a top rail extending from a back rail toward a front rail at acute angle;

a support frame member detachably connected to a bottom of said main frame member, said support frame member extending horizontally rearwardly of said back rail; and a foot means connected to said main frame member so as to support said main frame member in the generally vertical plane, said main frame member further comprising:

a bottom rail extending from a bottom of said back rail to a bottom of said front rail, said bottom rail extending horizontally, said foot means affixed to said bottom rail, said bottom rail having a length that is greater than a distance of said front rail to said back rail, said bottom rail having a portion extending rearwardly of said back rail, said support frame member connected to said portion, said foot means comprising a flat plate affixed to a bottom of said bottom rail and extending transversely to a longitudinal axis of said back rail, said flat plate extending in a horizontal plane.

15. A support apparatus comprising:

main frame member extending in a generally vertical plane, said main frame member having a top rail extending between front and back rails, said main frame member having a bottom rail connected to said front rail and said back rail;

a support frame member connected to said bottom rail of said main frame member, said support frame member extending horizontally rearwardly of said main frame member;

a first flat plate affixed to said support frame member adjacent the connection with said main frame member; and a second flat plate affixed to said support frame member rearwardly of said first flat plate, said first and second flat plates in parallel relationship to each other, said first and second flat plates extending in a generally horizontal plane, said support frame member having a side, said first flat plate and said second flat plate extending outwardly from said side and only said side of said support frame member, said first flat plate having a length which is less than a length of than said second flat plate.

16. The apparatus of claim 15, said top rail extending upwardly from said back rail at a generally 35° angle, said top rail having a horizontal portion adjacent said front rail, said acute angle of said top rail extending from an end of said horizontal portion opposite said front rail, a mid-rail extends horizontally from said back rail to said front rail, said mid-rail is positioned below said top rail and above said bottom rail, a flat plate is affixed to said bottom rail and extends transverse to a longitudinal axis of said bottom rail, said flat plate extends in a generally horizontal plane.

* * * * *